US006076293A

United States Patent [19]

Bergeron

[11] Patent Number: 6,076,293

[45] Date of Patent: Jun. 20, 2000

[54] THREE MESSAGE SIGN HAVING APEX ILLUMINATION

[76] Inventor: Paul E. Bergeron, 15 Gate 6 and ½ Rd., Sausalito, Calif. 94966

[21] Appl. No.: 09/195,721

[22] Filed: Nov. 18, 1998

[51] Int. Cl.[7] ..... G09F 11/02

[52] U.S. Cl. ..... 40/503; 40/506; 40/564; 40/502

[58] Field of Search ..... 40/502, 503, 504, 40/505, 564, 506

[56] References Cited

U.S. PATENT DOCUMENTS

| | | | |
|---|---|---|---|
| 2,504,396 | 4/1950 | De Marco | 40/505 |
| 4,073,081 | 2/1978 | Hunter, Jr. | 40/505 X |
| 5,416,996 | 5/1995 | Clemens et al. | 40/502 |

*Primary Examiner*—Terry Lee Melius
*Assistant Examiner*—James M. Hewitt
*Attorney, Agent, or Firm*—Townsend and Townsend and Crew LLP

[57] ABSTRACT

An illuminated three message sign is provided with improved illumination from the exterior of the vanes at the apices away from the sign surface exposed for message display. The sign has a message display side and an array of triangular rotating sign message displays. Each of the three sides of the triangular message displays in combination a message with corresponding sides of the other sign message displays. When the array of triangular sign message displays has the message surfaces of one of the arrays parallel to the display side, the sequential message is displayed. The apices of the sign message displays are each provided with cylindrical lenses. These cylindrical lenses register to slit light sources. By the expedient of providing a slit light source for each rotating message display, sequential illumination is provided as each message of the array rotates for viewer presentation. Additionally, an insert is disclosed for placement between an illuminated three message sign and fluorescent bulbs mounted interior of an illuminated menu box. This insert is provided with cylindrical lenses, which channel the conventional sign illumination into slit light sources registered to the apices opposite from the message display side of the sign. Thus, there is provided a three-message rotating message display sign array, which is especially adapted for light box mounting.

8 Claims, 3 Drawing Sheets

THREE MESSAGE SIGN HAVING APEX ILLUMINATION

This invention relates to three message display signs of the type where an array of discrete triangular vanes sequentially rotates to serially display three messages in sequence. The improvement disclosed relates to such a sign, which can be mounted to a conventional illuminated menu box. Specifically, a condenser optic is disclosed for receiving the ambient light illumination from the menu box and emanating slit light sources parallel to the rotating vanes of the sign. These slit light sources are registered to illuminate the internal apices of three sided sign message displays at the same time the viewer exposed message surface of the message display array presents one of the sequential messages to the viewer. Light received at these apices is then relayed to illuminate the viewer exposed message surface opposite the apices. Thus, simultaneous illumination is provided to all message displays of the array to illuminate in sequence the three viewer exposed messages.

BACKGROUND OF THE INVENTION

So-called three message signs are known. See for example Bergeron et al, WO 92/11621 published Jul. 9, 1992 entitled IMPROVED MULTI-MESSAGE SIGN. This patent illustrates an exemplary rotation mechanism for use with such signs.

Illumination of such signs has been a problem, especially where the sign itself is to provide the illumination for reading the sign at the message display. Three methods of such illumination are known.

First, it is known to illuminate internally each of the rotating message displays, by placing a light source, such as a fluorescent bulb. Unfortunately, placing a fluorescent bulb interior of a triangular and rotating sign message display gives severe difficulties both in the wiring of the fluorescent bulb and the mechanics of maintaining and or replacing the bulb within the rotating vane.

Second, and in order to prevent stray light from escaping from the rotating sign message displays, it has been known not only to mount the fluorescent bulbs interior of a rotating sign message display but also to provide internal light baffles in such signs. These baffles serve to block light from impinging on sides of the rotating sign message displays not exposed for view and concentrate light only on the message surfaces exposed for view. These baffle systems further complicate the mounting of the fluorescent bulb interior of the vanes.

Third, and in a move to avoid the complication of mounting fluorescent bulbs interior of the rotating sign message displays, it is known to mount lighting sources at the ends of the rotating sign message displays. Light from these ends then propagates interior of the triangular rotating sign message displays, illuminating all message surfaces. Such illumination systems again complicate sign construction as the necessary interval for both the generation and the introduction of light must be preserved in an area where the intermittent rotating motion of the three-message display array occurs.

A common form of advertising is the use of "menu boxes." These menu boxes are typically mounted in places of business. These boxes usually have a recessed interior illuminated by a plurality of fluorescent bulbs. In their use, the boxes are provided with a translucent face through which light from the fluorescent bulbs is diffused. When a translucent message covers the exterior of such menu boxes, the translucent message is back illuminated rendering its message visible to viewers.

SUMMARY OF THE INVENTION

An illuminated three message sign is provided with improved illumination from the exterior of the vanes at the apices away from the sign surface exposed for message display. The sign has a message display side and an array of triangular rotating sign message displays. Each of the three sides of the triangular message displays displays in combination a message with corresponding sides of the other sign message displays. When the array of triangular sign message displays has the message surfaces parallel to the display side, the sequential message is displayed. The apices of the sign message displays are each provided with cylindrical lenses. These cylindrical lenses register to slit light sources. By the expedient of providing a slit light source for each rotating message display, sequential illumination is provided as each message of the array rotates for viewer presentation. Additionally, an insert is disclosed for placement between an illuminated three message sign and fluorescent bulbs mounted interior of an illuminated menu box. This insert is provided with cylindrical lenses, which channel the conventional sign illumination into slit light sources registered to the apices opposite from the message display side of the sign. Thus, there is provided a three-message rotating message display sign array, which is especially adapted for light box mounting.

DESCRIPTION OF THE SPECIFIC EMBODIMENTS

Figure 1:
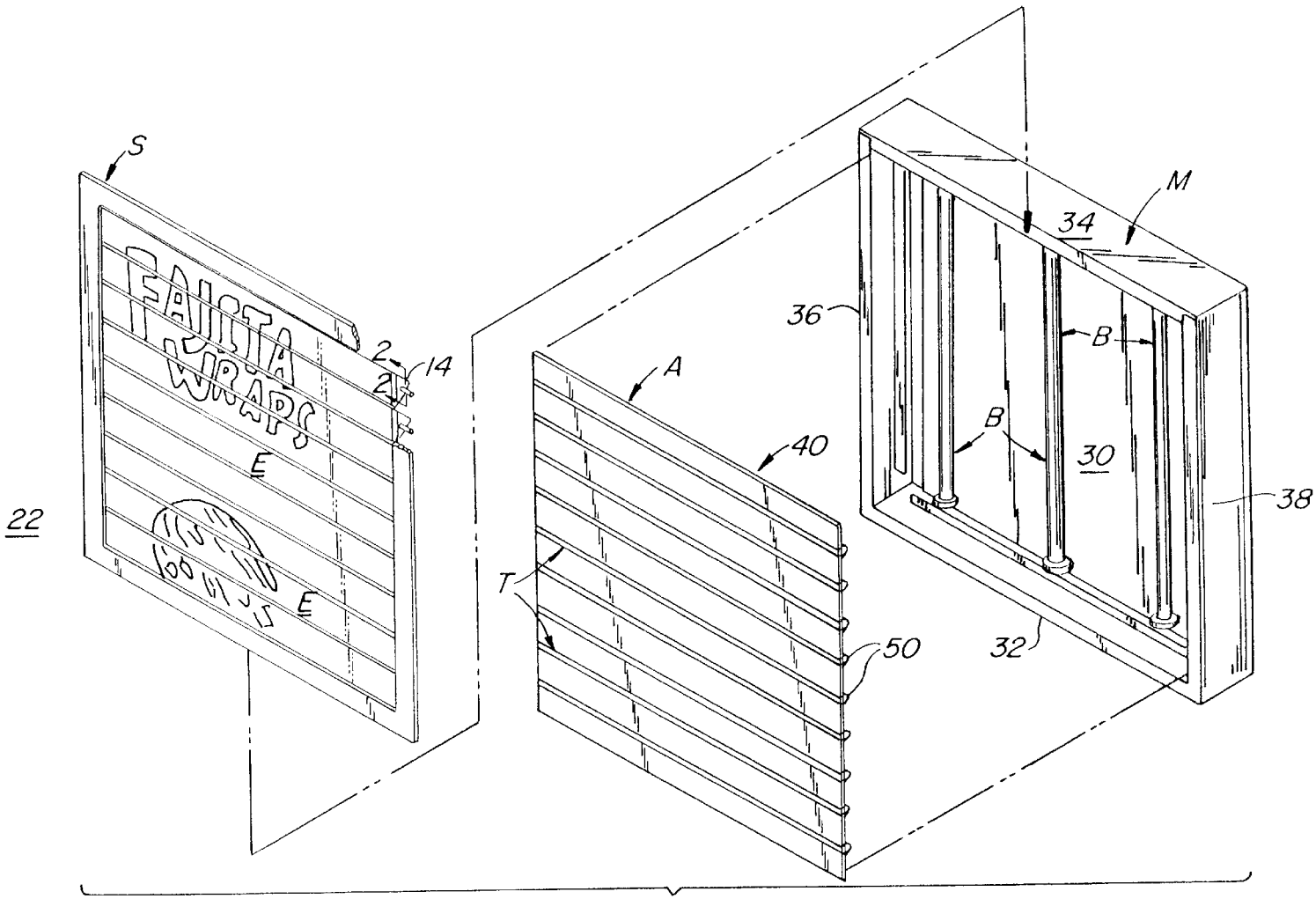
FIG. 1 is an exploded perspective view of a three message sign, a light condensing system for generating slit light sources for illuminating the message display side of the sign, and a conventional menu box having fluorescent bulbs for applying back illumination first through the light condensing system and then to the message display side of the sign.

Referring to FIG. 1, an exploded view of this invention is illustrated with three message sign S being placed to menu box M. In such placement, condenser lens array A is first placed interior of menu box M. Thereafter, three message display sign S is positioned over the top of condenser lens array A. As will hereafter be made clear, when all triangular sign message displays E rotate, illumination of one of the three sign messages occurs.

Having stated this much, three message display sign S can be briefly described. Simply stated this sign is described fully in referenced Bergeron et al, WO 92/11621 published Jul. 9, 1992 entitled IMPROVED MULTI-MESSAGE SIGN. A summary of operation will only be provided here so that the reader can understand easily the disclosure of this invention. Otherwise, this publication is incorporated herein by reference as if fully set forth herein.

Figure 2:
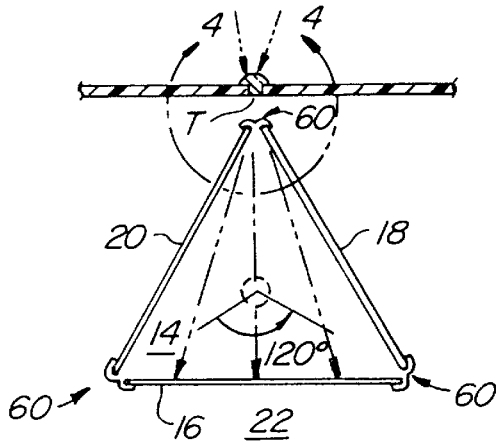
FIG. 2 is a cross-sectional view taken on lines 2—2 of FIG. 1 schematically illustrating the registration of the apex end of a rotating sign message display to the slit light source for the illumination of the message side of the sign message display.

Referring to FIG. 2, a single triangular message display 14 is shown having translucent message surfaces 16, 18, and 20. Translucent message surface 16 is shown facing display side 22 of the sign; as a result, translucent message surfaces 18 and 20 do not face the display side 22 of the sign. When all translucent message surfaces 16 are side-by-side and parallel, a discrete message is displayed. Here that message is "Fajita Wraps." It will likewise be understood that the arrays of translucent message surfaces 18 have their own discrete message. Likewise, the arrays of translucent message surfaces 20 can have another message.

Returning to FIG. 1, it will be seen that menu box M is an enclosed structure having back 30, bottom side 32, topside 34, left side 36, and right side 38. The interior of the formed box is highly reflective.

Illumination is provided as a standard item of manufacture. Specifically, three fluorescent bulbs B are provided. These fluorescent bulbs B illuminate backside 40 of condenser lens array A.

Figure 4:
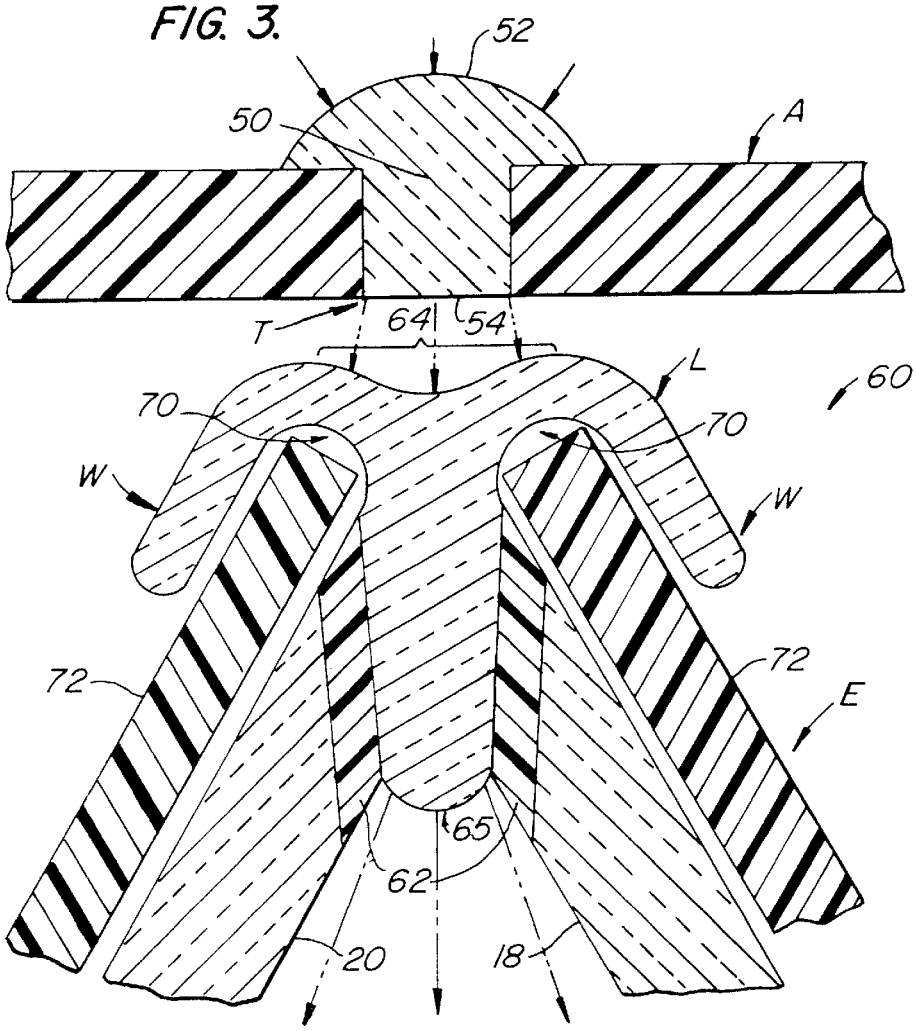
FIG. 4 is an enlarged view of a single sign message display of the sign message display array registered to a single slit light source of the slit light source array illustrating the construction of the lenses on both the slit light source array and the apex of the sign message display; and, FIG. 5 is an alternate means of illumination where the slit light sources are produced by small fluorescent bulbs, which are darkened except for a narrow slit for the emission of light.

Referring to FIG. 4, I have illustrated in the expanded view there shown the general operation of this invention on triangular sign message displays E. FIG. 4 is an expanded view of area 4—4 of FIG. 2. Condenser lens array A includes a series of light collection cylindrical lens 50. Each of these lenses has light collection surface 52 and slit transmission surface 54. Light from fluorescent bulbs B is collected at light collection surface 52, transmitted through light collection cylindrical lens 50, and emitted at slit transmission surface 54. Thus, condenser lens array A as it is mounted exposed to the back side of three message sign S forms the required slit light sources T for the illumination of triangular sign message displays E.

Returning to FIG. 4, the construction of sign message display E and the incorporation of cylindrical lens message displays L into apices 60 of each of the three sides of triangular sign message displays E is shown. First, it will be remembered that each triangular sign message displays E have three translucent message surfaces 16, 18, and 20. Cylindrical lens message displays L are joined to these respective translucent surfaces.

Second, and because translucent surfaces 16, 18 and 20 all trap and conduct light, it is necessary to place opaque barrier(s) 62 between cylindrical lens message displays L and translucent message surfaces 16, 18, and 20. Without the placement of these opaque barrier(s), it has been found that cylindrical lens message displays L can glow at the viewer exposed portions of the lenses giving to a viewer a disturbing distraction. Thus it will be understood that cylindrical lens message displays L are an integral part of triangular sign message displays E.

It is necessary that cylindrical lens message displays L collect light from slit light sources T. To this end, cylindrical lens message displays L are given concave collection surface 64. This surface then transmits light interior of cylindrical lens message display L and channels this collected light to light emission surface 65. All this is illustrated in FIG. 4.

Returning to FIG. 2, the operation of cylindrical lens message displays L is schematically shown. It will be seen that light is radiated from light emission surface 65 illuminates the backside of translucent message surface 16. As is shown in FIG. 1, this causes the message to be illuminated and displayed.

Figure 3:
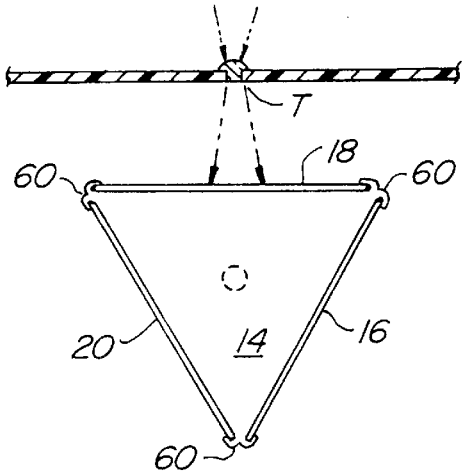
FIG. 3 is a view similar to FIG. 2 with the apex end rotated away from the slit light source illustrating the mode of the sign where the illumination dramatically dims.

This method of illumination also causes the sign to dim when a message is not being displayed. Referring to FIG. 3, it will be seen that as triangular sign message displays E rotate, their respective apices 60 rotate out of registry with slit light sources T. When this occurs, only small amounts of light from slit light sources T are captured by triangular sign message displays E. This causes the displayed message to dim when rotation of triangular sign message displays E occurs, further enhancing the viewers attraction to the sign. Thus, the viewer's attention is drawn to the sign not only by the changing message, but also by the changing intensity of illumination of the sign.

Returuing to FIG. 4, an additional feature of cylindrical lens message displays L can be set forth. Specifically, cylindrical lens message displays L is provided with message capture wings W. These message capture wings W form message capture channels 70. Thus individual translucent message strips 72 can be placed within the formed channels 70. There results the ability to change the sign messages.

Figure 5:
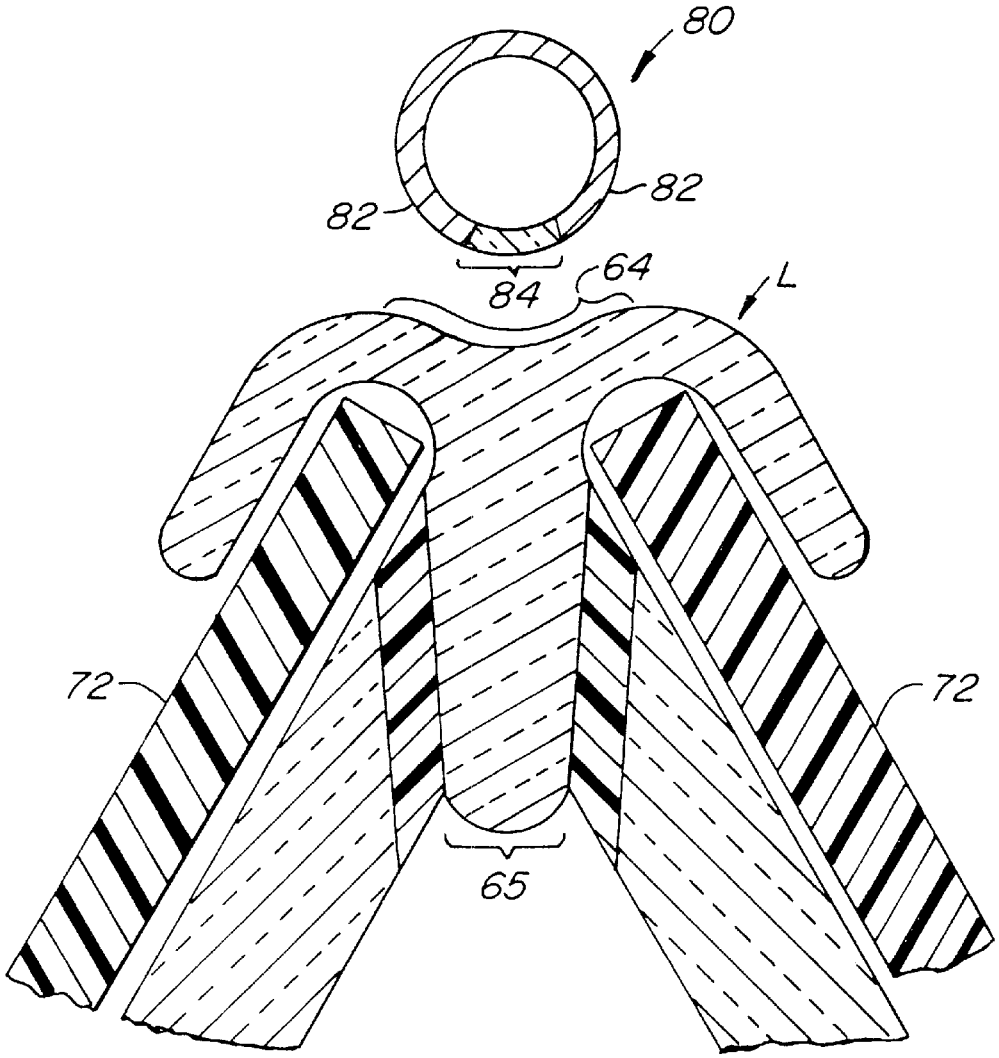

It will be understood that this invention is operable with virtually any slit light source T. Referring to FIG. 5, I illustrate such an alternate slit light source.

FIG. 5 includes ¼ inch diameter fluorescent light bulb 80. Bulbs 80 are coated with opaque coating 82, which opens at fluorescent slit light source 84. Thus, each fluorescent light bulb 80 forms a slit light source necessary for the illumination of the sign of this invention.

I have used the term "cylindrical lens" to describe the light transmitting fitting at the apices of the rotating sign message displays. These are extruded strips of plastic having compound curved surfaces, both negative and positive. These curves are essentially the same over the entire length of cylindrical lens message displays L. Thus any curvature that is provided is in two dimensions only; it does not have three dimensions. In this sense the lenses are "cylindrical."

It will be understood that I have shown two methods of generating slit light sources. Other methods may be used as well.

What is claimed is:

1. In a sign for serial display in a repeating format of three discrete messages, the sign including:

an array of side-by-side triangular sign message displays, each of the side-by-side triangular sign message displays having parallel side-by-side axes of rotation and three display surfaces joined at three apices for rotation about each respective axis of rotation, each display surface in correspondence with like display surfaces on side-by-side triangular sign message displays for permitting the array to display a discrete message when the array of the side-by-side triangular sign message displays is simultaneously rotated to present at the display surfaces a single message;

a housing for support of opposite ends of the array of the side-by-side triangular sign message displays;

each display surface having a message display side and an illumination side;

apparatus for rotating the side-by-side triangular sign message displays;

an improvement to the sign for serial display comprising:

a lens placed at each of the three apices of each sign message display for receiving light and radiating light to the message display side; and, an array of slit light sources spatially separated from and aligned with the array of the side-by-side triangular sign message displays, each slit light source for radiating light to one of the lenses of the side-by-side triangular sign message displays whereby the illumination side of the display surface opposite the apex is illuminated.

2. In a sign for serial display in a repeating format of three discrete messages according to claim 1 and wherein:

the array of slit light sources includes a plurality of light sources;

an array of condenser optics for collecting light from the plurality of light sources; and, a plurality of slits connected to the condenser optics for forming the array of slit light sources.

3. In a sign for serial display in a repeating format of three discrete messages according to claim 1 and wherein:the array of slit light sources includes a fluorescent bulb at each slit light source.

4. In a sign for serial display in a repeating format of three discrete messages according to claim 3 and wherein:

the fluorescent bulbs are coated to emit light along a slit.

5. A process for sequential illumination of three discrete messages for serial display comprising the steps of:

providing an array of side-by-side triangular sign message displays, each of the side-by-side triangular sign message displays having parallel side-by-side axes of rotation and three display surfaces joined at three apices for rotation about each respective axis of rotation, each display surface in correspondence with like display surfaces on side-by-side triangular sign; sign message displays for permitting the array to display a discrete message when the array of the side-by-side triangular sign message displays is simultaneously rotated to present at the display surfaces a single message;

providing a housing for support of opposite ends of the array of the side-by-side triangular sign message displays having a message display side and an illumination side;

providing apparatus for rotating the side-by-side triangular sign message displays;

providing a lens at each apex of the three apices for receiving light and radiating light to the message display side; and, providing an array of slit light sources spatially separated from and aligned with the array of the side-by-side triangular sign message displays, each slit light source for radiating light to one of the lenses of the side-by-side triangular sign message displays whereby a back side of the display surface opposite the apex having the lens is illuminated for message display;

rotating the side-by-side triangular sign message displays to register each lens to each corresponding slit light source whereby a message is illuminated when all lenses of the side-by-side triangular sign message displays are registered to the slit light sources and the message is not illuminated when all lenses of the side-by-side triangular sign message displays are not registered to the slit light sources.

6. In a sign for serial display in a repeating format of three discrete messages, the sign including:

an array of side-by-side triangular sign message displays, each of the side-by-side triangular sign message displays having parallel side-by-side axes of rotation and three display surfaces joined at three apices for rotation about each respective axis of rotation, each display surface in correspondence with like display surfaces on side-by-side triangular sign message displays for permitting the array to display a discrete message when the array of the side-by-side triangular sign message displays is simultaneously rotated to present at the display surfaces a single message;

a housing for support of opposite ends of the array of the side-by-side triangular sign message displays;

apparatus for rotating the side-by-side triangular sign message displays;

an improvement to the sign for serial display comprising:

a lens for placement between each of the apices of each sign message display, the lens including a light receiving surface for receiving light from an exterior of the side-by-side triangular sign message display;

a light conducting portion of the lens for conducting light from the light receiving surface to a light emitting surface interior of the side-by-side triangular sign message display; and, a light emitting surface for transmitting light from the lens to a display surface opposite the lens whereby the display surface opposite the lens is back illuminated;

an array of slit light sources for registering light to each lens when each lens is in alignment with each respective light source.

7. In a sign for serial display in a repeating format of three discrete messages according to claim 6 and wherein:

the lens is a cylindrical lens placed adjacent translucent display surfaces; and at least one opaque barrier is placed between the translucent display surfaces and the cylindrical lens.

8. In a sign for serial display in a repeating format of three discrete messages according to claim 7 and wherein:

the cylindrical lens includes channel arms for receiving and holding sign message strips to the display surfaces of the side-by-side triangular sign message displays.

* * * * *